United States Patent [19]

Tashman

[11] 4,130,054

[45] Dec. 19, 1978

[54] TOP LOADING WASTE COMPACTOR

[76] Inventor: Philip Tashman, 7500 NW. 41 St., Miami, Fla. 33166

[21] Appl. No.: 794,251

[22] Filed: May 5, 1977

[51] Int. Cl.[2] ..... B30B 15/22

[52] U.S. Cl. ..... 100/52; 100/53; 100/100; 100/215; 100/229 A; 100/295

[58] Field of Search ..... 100/52, 53, 229 A, 100, 100/295, 269 R, 215; 53/124 B; 141/73, 80

[56] References Cited

U.S. PATENT DOCUMENTS

| | | | |
|---|---|---|---|
| 594,008 | 11/1897 | Hanak | 100/295 |
| 3,601,953 | 8/1971 | Boyd | 100/229 A |
| 3,691,944 | 9/1972 | Boyd | 100/229 A |
| 3,808,967 | 5/1974 | Fair | 100/229 A |
| 3,831,513 | 8/1974 | Tashman | 100/229 A |
| 3,838,635 | 10/1974 | Hardy | 100/229 A |
| 3,868,903 | 3/1975 | Montalbano | 100/229 A |
| 3,869,978 | 3/1975 | Steinberg | 100/229 A |
| 3,890,890 | 6/1975 | Hennells | 100/229 A |
| 3,901,139 | 8/1975 | Moriconi | 100/229 A |

*Primary Examiner*—Billy J. Wilhite
*Attorney, Agent, or Firm*—Ernest H. Schmidt

[57] ABSTRACT

A portable waste compactor for automatically compressing, from above, waste material deposited in a dolly-supported waste bin has a hydraulically actuated reciprocable ram mechanism including a ram plate operative to compress the waste material within the waste bin. A chute leading to the waste bin extends forewardly thereof and of the ram mechanism, and has a top opening for the feeding of waste material to be compacted. The ram plate is pivotally mounted with respect to a ram cylinder piston and cam means is provided for tilting the forward end of the ram plate upwardly to provide for unimpeded passage of refuse through the chute into the compacting bin when the said ram is at its uppermost position of rest at the end of a cycle of ram operation. Electrical interlocking means controlling operation of the hydraulic system prevents operation of the ram mechanism unless the dolly and its associated refuse bin is in proper position, and unless a cover covering the waste discharge chute is in closed position.

8 Claims, 9 Drawing Figures

TOP LOADING WASTE COMPACTOR

This invention relates to waste disposal apparatus and is directed particularly to a portable waste compactor for compressing to a solid compact mass cans, bottles, milk cartons, disposable food containers, food scraps and the like waste materials accompanying the operation of cafeterias, lounges or dining facilities in industry, hospitals, hotels, school restaurants etc. In applicants U.S. Pat. No. 3,831,513 issued Aug. 27, 1974 and titled Portable Solid Waste Compactor, there is described a side-loading portable waste compactor for automatically compressing refuse or waste into a compact mass for efficient disposal. This application has as its principal object the improvement in various respects of the waste compactor described therein, particularly with respect to the substantial reduction in overall height, and the provision of simplified top loading.

A more particular object of the invention is to provide a portable solid waste compactor of the character described including a hydraulic piston actuated compacting ram receprocatively driven into a dolly-supported refuse bin for compacting waste deposited therein, wherein the waste is loaded through a forewardly offset, open-topped chute leading to the waste bin, and wherein the compacting ram plate, when in its uppermost position at the end of a cycle of compaction, automatically assumes an inclined position allowing for free passage of the waste through the chute into the dolly at a minimum length of withdrawal stroke of the ram, thereby minimizing the overall height of the compactor mechanism. Another object of the invention is to provide a waste compactor of the above nature which, because of its compact size, particularly with respect to height, as compared with compactors of like capacity heretofore devised, is particularly well suited and adpated for use in waste generating establishments or businesses having limited equipment space, such as in bars, lounges, lunch rooms, fast food service facilities, etc.

Yet another object of the invention is to provide portable solid waste compactor of the above nature including electrical interlock means to prevent operation of the ram unless and until the waste bin dolly is properly positioned in the main compactor unit and the waste chute access door is closed.

Yet another object of the invention is to provide a portable solid waste compactor wherein the reciprocative compacting ram is controlled by a double-acting hydraulic piston, and wherein withdrawal of the ram pressure plate is automatically effected upon the buildup of hydraulic pressure on the downward stroke exceeding a predetermined value determined by the degree of compaction desired.

Another object of the invention is to provide a portable solid waste compactor wherein the control circuitry of the hydraulic system is incorporated for the most part in a modular control panel provided with quick disconnect electrical connector plug members permitting easy removal for repair and replacement whenever necessary.

Still another object is to provide a top loading portable solid waste compactor which will be simple in construction, easy to clean, self-contained, readily movable from place to place, attractive in appearance, foolproof in operation, and durable in use.

Other objects, features and advantages of the invention will be apparent from the following description when read with reference to the accompanying drawings. In the drawings, wherein like reference numerals denote corresponding parts throughout the several views.

Figure 2:
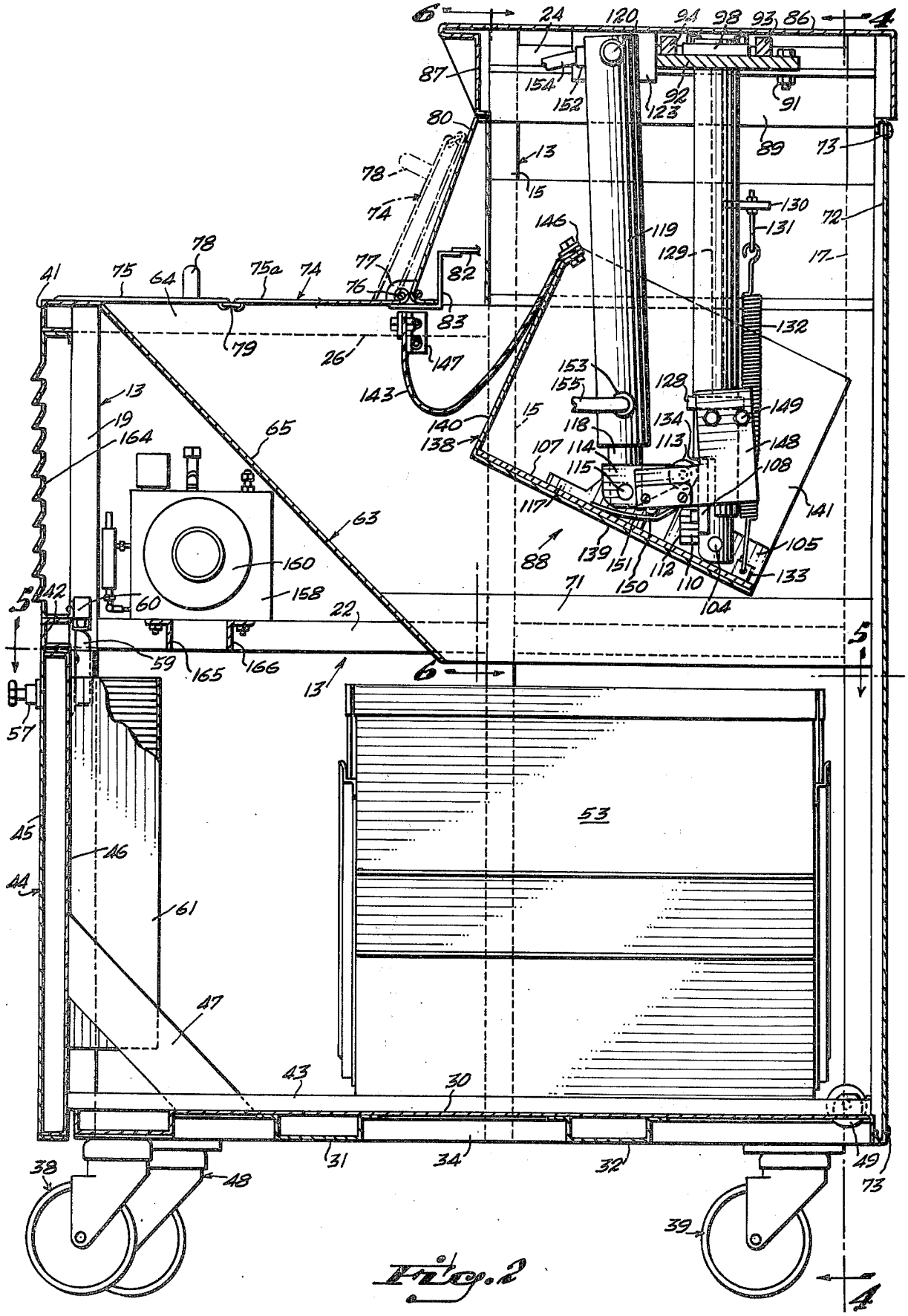
FIG. 2 is a vertical cross-sectional view taken along the plane indicated at 2—2 of FIG. 1 in the direction of the arrows.
Figure 6:
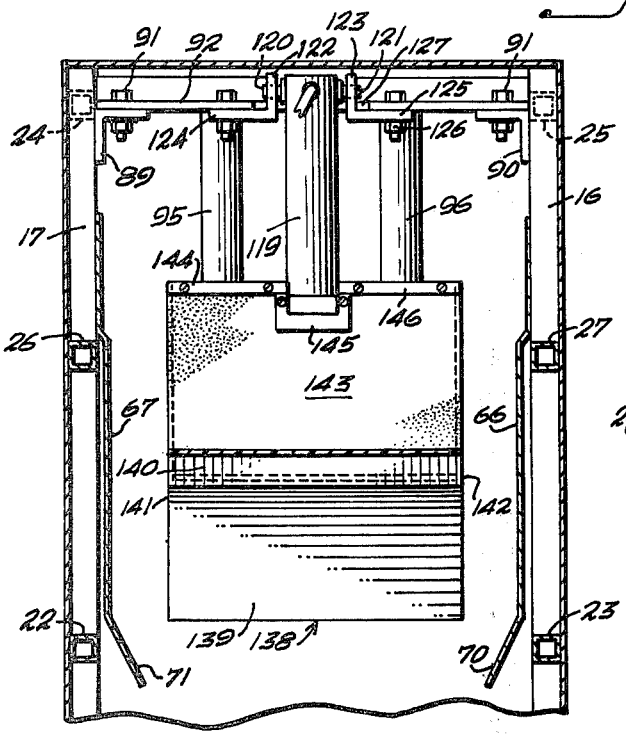
FIG. 6 is a vertical cross-sectional view taken along the plane indicated at 6—6 of FIG. 2 in the direction of the arrows.

Referring now in detail to the drawings, reference numeral 10 designates, generally, a preferred form of waste compactor embodying the invention, the same being comprised of an upstanding main compactor unit 11 and a withdrawable waste bin dolly 12. The main compactor unit 11 comprises a three dimensional rectangular framework 13 including pairs of spaced, parallel, co-extensive front corner posts 14, 15 and rear corner posts 16, 17, all of which are preferably of steel tubing having a square cross-sectional shape. The framework 13 further comprises a pair of comparatively short front corner posts 18 and 19 in front to back alignment with respective corner posts 14, 16 and 15, 17. The corner posts 14 through 19 are secured in their relatively spaced positions by lower front-to-back spacer members 20, 21 intermediate front-to-back spacer members 22, 23 and uppermost spacer members 24, 25 (see FIGS. 2 and 4). As illustrated in FIGS. 2 and 6, the framework 13 further comprises horizontal spacer members 26, 27 interjoining the upper ends of the foreshortened front corner posts 18 and 19 with corner posts 14 and 15. The intermediate front-to-back spacer members 22, 23 extend forwardly to interjoin intermediate zones of the foreshortened front corner posts 18 and 19.

Figure 4:
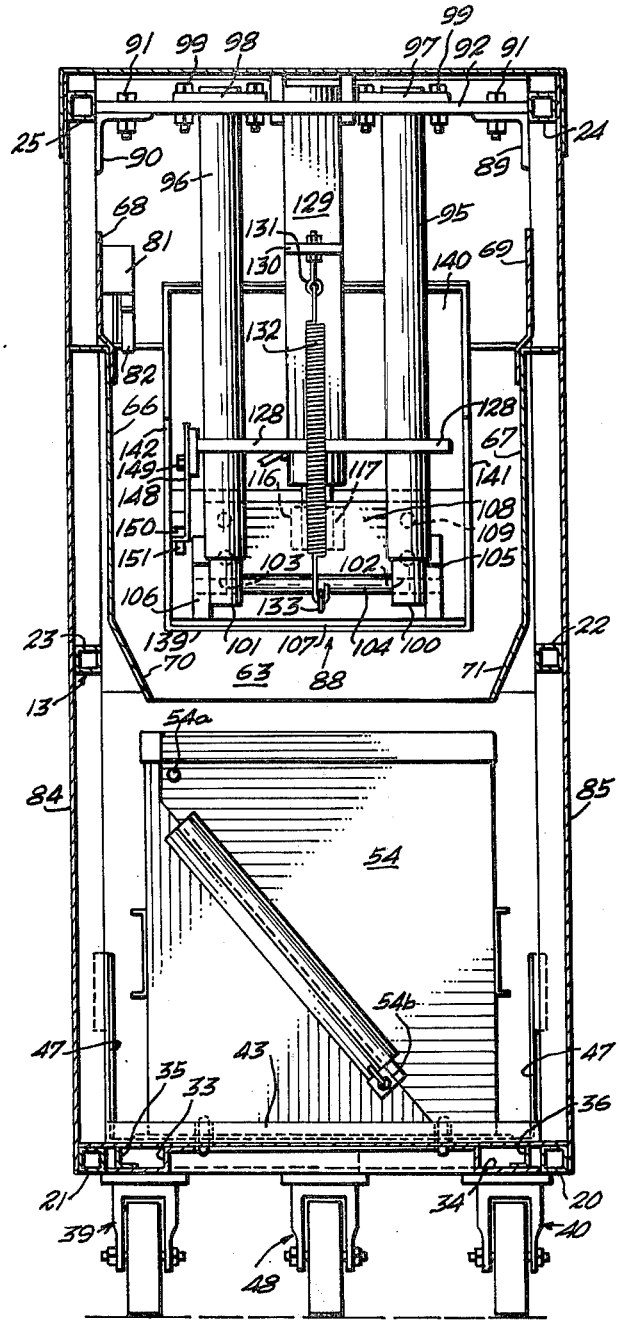
FIG. 4 is a vertical cross-sectional view of the compactor taken along the plane indicated at 4—4 of FIG. 2 in the direction of the arrows.

The framework 13 further comprises a bent sheet metal base 30 reinforced at the underside with a pair of side-to-side, mutually-spaced reinforcing ribs 31, 32 (see FIG. 2) of U-shaped configuration, which are preferably welded in place. As best illustrated in FIG. 4, marginal side portions of the base plate 30 are reinforced from front to back by the use of welded-in-place, downwardly-offset angle brackets 33, 34, the open ends of which are closed by co-extensive welded-in-place angle members 35, 36. A pair of front caster wheel assemblies 37, 38 and rear caster wheel assemblies 39, 40 welded or otherwise secured at the four corners of the compactor framework provide for rolling portability of the compactor (see FIGS. 1 and 4).

Figure 1:
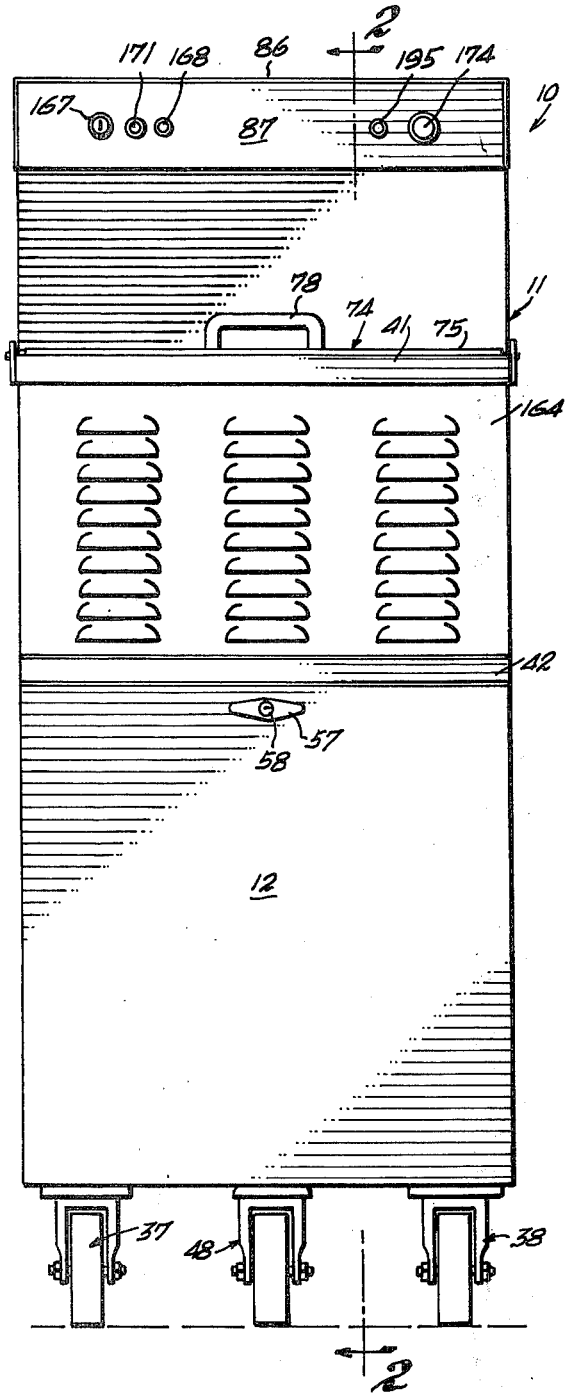
FIG. 1 is a front elevational view of a waste compactor embodying the invention.

As illustrated in FIGS. 1 and 2, the upper ends of the comparatively short front corner posts 18 and 19 are joined by a horizontal, side-to-side upper front framework member 41, and an intermediate framework member 42 at the level of the front ends of front-to-back spacer members 22, 23.

Figure 5:
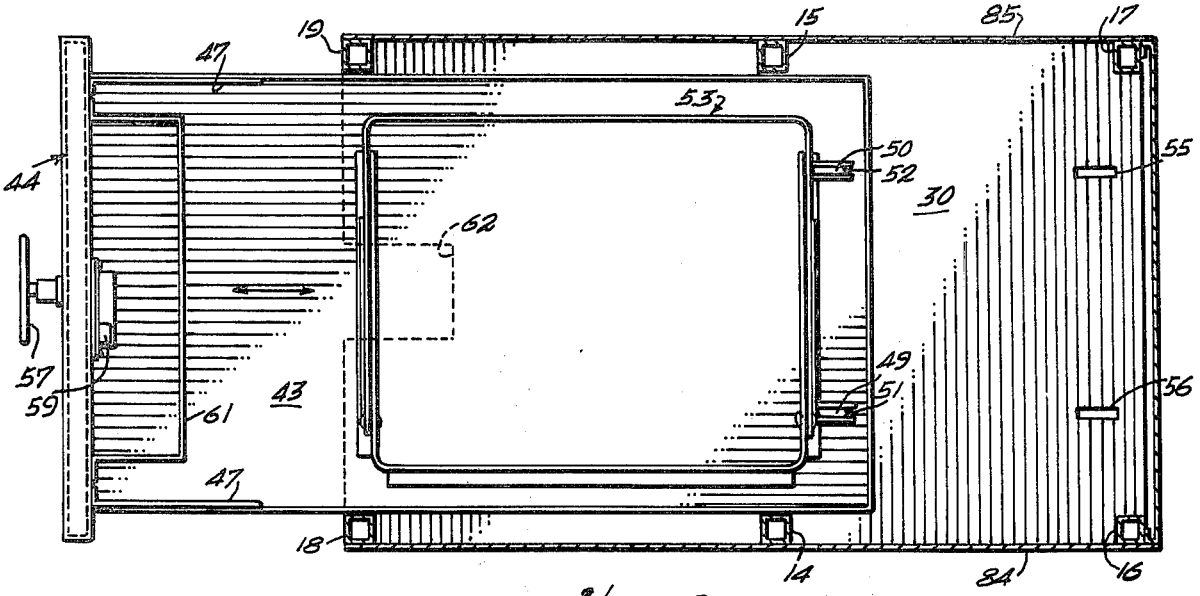
FIG. 5 is a horizontal cross-sectional view taken along the plane indicated at 5—5 of FIG. 2 in the direction of the arrows.

The rectangular space between the base 30 and the framework front-to-back spacer members 22, 23 constitutes a chamber for the roll-in reception of the removable waste bin dolly 12. As is best illustrated in FIGS. 2, 4 and 5, the dolly 12 comprises a flat rectangular base 43, which will preferably be fabricated of bent sheet metal suitably reinforced by sheet metal ribs or the like, fixed to the forward end of which is a rectangular front panel 44, said front panel being preferably formed of a pair of inner and outer sheet metal panel members 45, 46 secured in spaced, parallel relation. The front panel 44 is rigidly secured with respect to the base 43 by angular sheet metal struts 47 welded therebetween at each side, (only one strut illustrated in FIG. 2). As best illustrated in FIGS. 1, 2 and 4, the foreward end of the dolly 12 is supported by a central caster wheel assembly 48; and the rearward end of the dolly base 43 is fitted with a pair of laterally-spaced roller wheels 49, 50, journalled above said base and extending partially through respective openings 51 and 52 therein. Supported upon the dolly base 43 is a rectangular, box-like enclosure or bin 53 for containing the waste to be compacted. The waste bin 53 will preferably be constructed of bent sheet metal, appropriately reinforced with welded-in-place, bent sheet metal ribs or the like, and comprises an upper interfitting portion 54, separable along a diagonal and swingable upwardly about pivot pin **54*a* for facilitating removal of waste compacted therein in the manner hereinafter more particularly described. Latches 54*b* at each side, (only one illustrated in FIG. 4) serve to retain the upper bin portion 54 securely in place during compacting. Since the constructional details of the waste compacting bin 53** are not claimed as novel other than in its association with the remainder of the compactor mechanism, further description thereof is not considered to be necessary for a proper understanding of the invention.

As illustrated in FIGS. 2, 3, 4 and 5, the base 30 of the framework 13 is provided, at the rear end thereof, with a pair of laterally spaced slots 55, 56 for the interfitting reception of downwardly protruding portions of the dolly roller wheels 49, 50 when the dolly 12 is fully received within the main compactor unit 11. The roller wheels 49, 50 thus facilitate insertion and removal of the dolly 12 while at the same time providing for face-to-face seating engagement of the underside of the dolly base 43 upon the upper surface of the main compactor framework base 30 for firm support during the compacting process hereinafter described.

A central lock latch handle 57 at the front of the front panel 44 near the upper end thereof facilitates moving the dolly between positions of use in association with the main compactor unit 11 for receiving and having waste compaced in bin 53, and withdrawn positions for convenient removal for disposal of compacted waste. In order that the compactor cannot be operated without the waste bin dolly 12 being properly fitted in place, the latch handle 57 comprises a key lock 58 operating a latch 59 (see FIG. 2) which, when in closed and latched position behind intermediate framework member 42, actuates to closecircuit normally open microswitch 60, said microswitch being in series connection in the energization circuit controlling operation of the compactor ram, as is hereinafter more particularly described. As further illustrated in FIGS. 2 and 5, the inner panel 46 of the dolly front panel 44 has welded or otherwise secured thereto a rectangular bent sheet metal partition member 61, which defines a chamber for use in storing plastic bags for lining the compactor bin 54. As best illustrated in FIG. 5, the forward end of the framework base 30 is provided with a rectangular, centrally located recess 62 for the reception of the dolly caster wheel asembly 48 when the dolly 12 is fully received within the reception chamber of the main compactor unit 11.

As best illustrated in FIGS. 1, 2 and 4, a bent sheet metal chute 63 is provided for guiding waste to be compacted from a waste reception opening 64 at the top front of the compactor to the dolly waste bin 53 for compaction. The chute 63 comprises an inwardly inclined front sheet metal portion 65 extending from the inside of the upper ends of the foreshortened front corner posts 18 and 19 to a position just above and somewhat inwardly of the front of the dolly refuse or trash bin 53 when in operational position. The inclined front sheet portion 65 joins with opposed side chute portions 66, 67 (See FIG. 4) which are welded at their upper ends to front-to-back brackets 68, 69 fixed between corner post pairs 14, 18 and 15, 19, respectively, at inside surface portions thereof. The lower ends of the side chute portions 66, 67 are mutually inwardly bent, as indicated at 70, 71 in FIG. 4. A removable back panel 72 secured in place with respect to the framework structure 13 as by screws 73 serves to enclose the rear of the compactor as well as the rear of the bent sheet metal chute 63.

As further illustrated in FIGS. 2 and 1, the waste reception opening 64 leading to the refuse chute 63 has a cover 74 comprising relatively hinged front and rear cover panels **75, 75*a*, rear cover panel 75*a* of which is pivotally journalled to a transverse pivot rod 76 secured at each end to a hinged bracket 77. The front cover panel 75 has affixed thereto a handle 78 facilitating the folding together of said front cover panel and rear cover panel 75*a* about hinge 79 and with respect to journal rod 76 when moving the hinged cover to the open position as indicated by the broken-line representation thereof in FIG. 2. As best illustrated in FIGS. 1 and 2, the front portion of the compactor framework above the waste reception opening 64 is enclosed by an inclined cover panel 80 against which the hinged cover 74** rests when in open position.

Means is provided to prevent operation of the compactor when the hinged chute cover 74 is in open position. To this end there is fixed against the inside of the chute support bracket 68 a normally open single-pole microswitch 81 having an actuating lever 82 positioned and adapted to be actuated by an extension bracket 83 fixed with respect to and extending inwardly of the rear cover panel **75*a*. As is hereinafter more particularly described, the normally open microswitch 81 is connected in series as an interlock in the electrical control circuitry, as is microswitch 60 associated with dolly 12, to prevent operation of the compactor without said dolly first being latched in place and said hinge cover being closed. As illustrated in FIGS. 1, 4 and 5, the compactor framework is also enclosed by side panels 84, 85 and the top is enclosed by a skirted top panel 86, all held in place by sheet metal screws or the like to provide for easy removal for inspection and servicing of the ram. As illustrated in FIG. 1, the skirted top panel 86 is formed with a front vertical panel portion 87** in which are mounted compactor energizing circuit control and indicator components, as is hereinafter more particularly described.

The compactor further comprises a compactor ram assembly, indicated, generally, at 88 in FIG. 2, supported within the framework 13 from the uppermost end thereof. To this end, a pair of channel iron members 89, 90 (see FIGS. 2, 4, 6 and 7) are supported in fixed relation between the corner post pairs 15, 17 and 14, 16, respectively, to retain said channel iron members in spaced, front-to-back parallel relation. Extending between and bolted upon upper surface portions of the channel iron members 89, 90 as by machine bolts 91 is a substantially rectangular ram assembly support plate 92. As best illustrated in FIGS. 2 and 7, the support plate 92 has welded upon and along the upper surface thereof a pair of spaced, parallel rectangular rib members 93, 94 for reinforcing purposes.

Figure 3:
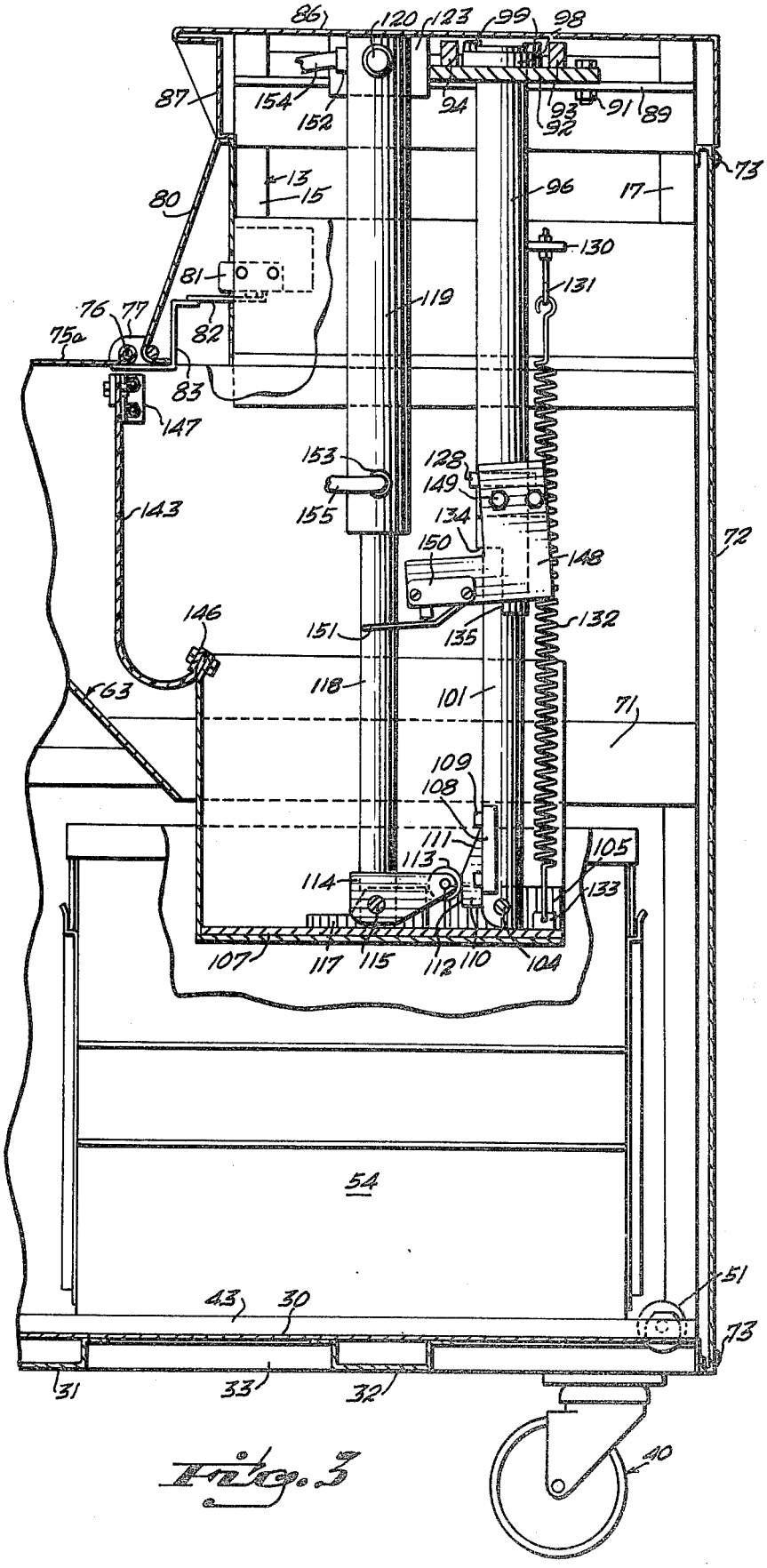
FIG. 3 is a vertical cross sectional view similar to that of FIG. 2, but illustrating the ram in its lowermost position of compaction.

Fixed with respect to and extending downwardly of the ram assembly support plate 92 are a pair of laterally spaced ram slide bar cylinders 95, 96. The upper ends of the slide bar cylinders 95, 96 extend through circular openings in the support plate 92 to terminate in welded-in-place rectangular flanges 97, 98 which are bolted to said support plate as by bolts 99. Slidingly received within the slide bar cylinders 95, 96 are respective slide bars 100, 101 which, at their lower ends, are provided with aligned, transvere through opening 102, 103, respectively, journalling a common pivot pin 104. The pivot pin 104 extends outwardly of each of the slide bars 100, 101 to be pivotally journalled in respective bearing brackets 105, 106 welded or otherwise secured to laterally spaced upper surface portions of a rectangular ram plate 107. As is best illustrated in FIGS. 3 and 4, lower end portions of the slide bars 100, 101 at the front thereof, are recessed to provide for the interfitting reception of opposite end portions of a cross support bar 108 secured in place as by machine screws 109. Welded or otherwise securely affixed to the front surface of the cross support bar 108, at a central position theralong, is a cam member 110 having outwardly and downwardly divergent cam surface portion 111, merging with and terminating in a vertically downwardly extending cam surface portion 112. A cam follower wheel 113, cooperative with the cam member 110 as is hereinafter more particularly described, is journalled in a support block 114 which, in turn, is pivotally journalled by means of transverse pivot pin 115 between journal blocks 116, 117 at each side thereof that are fixed as by welding against the upper surface of ram plate 107. The cam wheel support block 114 is also formed with a vertical opening or bore within which is received the lower end portion of piston rod 118 of ram actuating hydraulic cylinder 119, said lower end of said piston rod being securely attached to said cam support block by virtue of the pivot pin 115 thereof extending through an aligned transverse opening in said piston rod.

Figure 7:
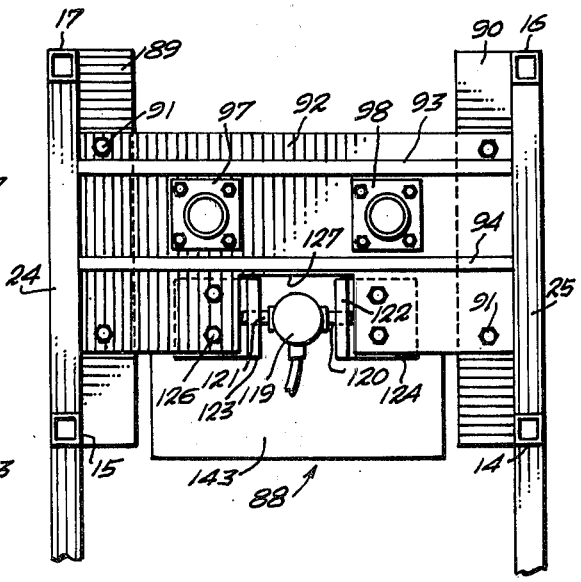
FIG. 7 is a partial view of the compactor as seen from the top with the skirted top panel removed.

As is best illustrated in FIGS. 3, 6 and 7, the upper end of the hydraulic cylinder 119 is provided with an opposed pair of laterally outwardly-extending pivot pins 120, 121 journalled in upstanding leg portions 122, 123, respectively of angle brackets 124, 125 affixed to the underside of the ram assembly support plate 92 as by bolts 126 and extending upwardly through a rectangular recess 127 cut in said support plate along a front central portion thereof (see FIG. 7).

The slide bar cylinders 95, 96, as is best illustrated in FIGS. 2 and 4, carry a relatively fixed rectangular support plate 128, said support plate being provided with circular opening through which said slide bar cylinders extend. Support plate 128 has affixed against the upper surface thereof a rectangular support bracket 129 the upper end of which is welded or otherwise fixed with respect to the ram assembly support plate 92. The vertically extending rectangular support bracket 129 carries, intermediate its length and extending outwardly of the rear thereof, a bracket member 130 adjustably attached with respect to which is a hook eye 131 to which is hooked the upper end of the helical tension spring 132. The lower end of the spring 132 is hooked to a bracket 133 affixed to and extending upwardly of the ram plate 107 at a central, rear portion thereof.

The hydraulic ram 119 is double acting, that is, is operative to forcefully move its piston rod 118 between fully withdrawn position, as is illustrated in FIG. 2, and fully extended position, as illustrated in FIG. 3. When in its fully withdrawn position as illustrated in FIG. 2, the upper edge of the cross support bar 108 will have come into abutting engagement with respect to horizontal shoulder portions 134 of rectangular recesses 135 formed in the front of the lower ends of the slide bar cylinders 95, 96 (only one recess 135 illustrated in FIGS. 2 and 3). As illustrated in FIG. 2, subsequent withdrawal of the piston rod 118 serves to swing the forward end of the ram plate 107 upwardly, to provide for free passage of refuse or trash through the chute 63 for deposit in the trash bin 53 prior to compaction. In this connection it is to be noted that the tension spring 132 is so arranged as to resiliently urge the slide bars 100, 101 and the associated ram plate 107 in the uppermost position whereat the cross support bar 108 will abut the horizontal should portions 134 of the rectangular recesses 135 formed in the front of the lower ends of respective slide bar cylinders 95, 96. As soon as this has occurred, furthur withdrawal or upward movement of the piston rod 118 will cause the ram plate 107 to pivot upwardly about pivot pin 104 fixed between the lower ends of the slide bars 100, 101 as hereinabove described, the front lower end portions of said slide bars being cut away along an arc 136 (only one illustrated in FIGS. 2 and 3) to permit such relative movement of said ram plate. It will be noted that at such time as the slide bars 100, 101 reach their uppermost position as described above, further withdrawal or retraction of hydraulic rod 118 causes the cam follower roller 113 to ride along in the angular surface portion 111 of the cam member 110 to provide for inward canting of the hydraulic cylinder 119 about its upper pivot pins 120, 121 until the uppermost limit position is reached, as illustrated in FIG. 2. Upon subsequent downward movement of the hydraulic cylinder piston rod 118 at the commencement of a cycle of compacting ram operation, the cam roller wheel 113 will ride down the inclined surface of the cam member 110 to come to rest against the downwardly extending portion 112 thereof whereat, as illustrated in FIG. 3, hydraulic piston rod 118 and slide bars 100, 101 will be mutually parallel, and the ram plate 107 will lie in the substantially horizontal plane at the lower ends of said piston rod and slide bars. It will also be observed that the cam wheel 113 associated with the hydraulic piston rod 118, being in abutment with the flat vertical surface 112 of cam member 110, prevents lateral inward movement of the hydraulic piston rod 118 with respect to the slide bars 100, 101, and thereby prevents tilting of the ram plate 107 beyond the horizontal position during a downward or compacting stroke as illustrated in FIG. 3. It is further to be understood that the tension spring 132, being fully stressed when the ram plate 107 is in its lowermost position, aids in the retraction of the slide bars 100, 101 upon the withdrawal of hydraulic piston rod 118 during upward return movement of the ram so that said ram plate will remain at a substantially horizontal position until said slide bars reach their uppermost limit position just prior to the tilting of said ram plate 107, as is hereinabove described.

As best illustrated in FIGS. 2, 3 and 6, the ram plate 107 seats against the inside bottom of a rectangular box-like enclosure 138, open at the back and at the top and comprising a bottom panel 139, a front panel 140 and side panels 141 and 142. A flexible rectangular shroud 143 is clamped at one end along a marginal upper edge portion to the upper edge portion of front panel 140 as by clamp bars 144, 145 and 146, the other end of said shroud being affixed to an appropriate clamping bracket 147 within an upper end portion of the refuse chute 63. As illustrated in FIGS. 2 and 3, the shroud 143 serves as a screen to prevent accidental passage of refuse being fed through the chute 63 into the box-like enclosure 138 whereat it might interfere with proper operation of the above-described ram mechanism.

As further illustrated in FIGS. 2, 3 and 4, a bracket 148 secured with respect to support plate 128 as by bolts 149 carries a single-pole, double-throw ram limit microswitch 150 having a forwardly-extending actuating arm 151. When the ram plate 107 is withdrawn to its uppermost position as illustrated in FIG. 2, the microswitch actuating arm 151 will be contacted by an upper surface portion of said ram plate to switch microswitch 150 from one pole position to the other for appropriately controlling the associated ram actuating electrical circuitry, as is hereinafter more particularly described.

Figure 8:
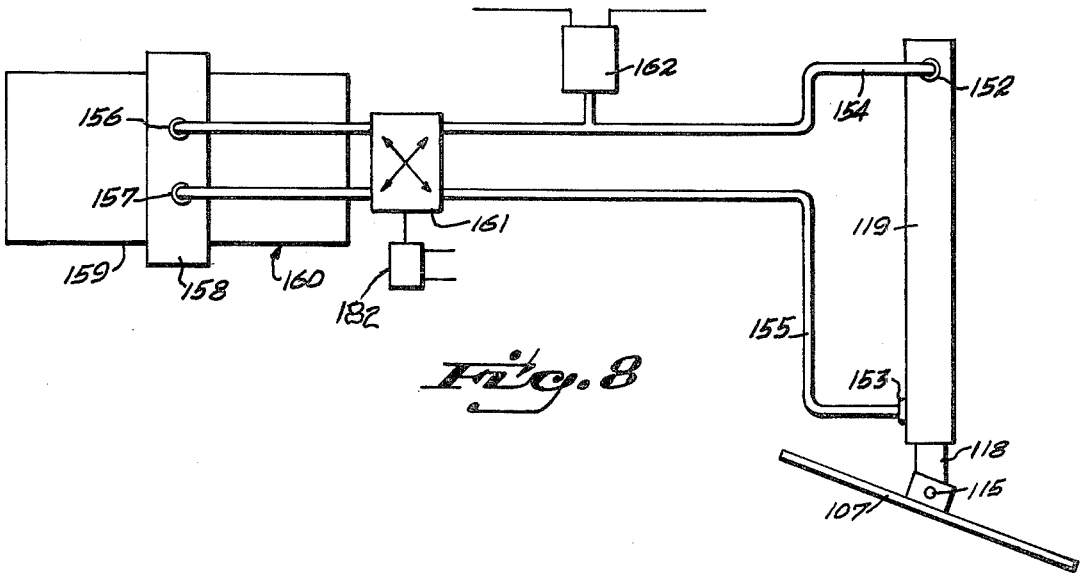
FIG. 8 is a schematic diagram of the hydraulic control system.

Referring now to FIG. 8, which is a schematic diagram of the hydraulic control system, it will be seen that the double-acting ram operating hydraulic cylinder 119 has its upper and lower hydraulic fluid ports 152, 153 connected through flexible conduits 154, 155 and solenoid-actuated flow reversal valve 159, with hydraulic fluid pressure ports 156, 157 of fluid pump 158. Fluid pump 158 comprises part of an assembly including a pump motor and hydraulic fluid reservoir, indicated generally at 160. The solenoid controlled reversing valve 161, which may be part of the fluid pump 158, is spring loaded and serves to reverse the direction of hydraulic fluid flow in the fluid conduits 154, 155 leading to the ram operating hydraulic cylinder 119, as is hereinafter more particularly described. A normally closed fluid pressure switch 162 communicating with fluid pressure conduit 154 serves to open-circuit its normally closed single-pole switch 163 (see FIG. 9) upon the ram plate 107 reaching its lowermost position in a compacting cycle of operation, as is hereinafter more particularly described.

As illustrated in FIG. 2, the hydraulic system fluid pump assembly 160 is located behind louvered front panel 164, underneath the inclined front portion 65 of the refuse chute 63, being supported upon a pair of spaced, parallel angle iron members 165, 166 welded or otherwise secured between intermediate front-to-back framework spacer members 22, 23.

Figure 9:
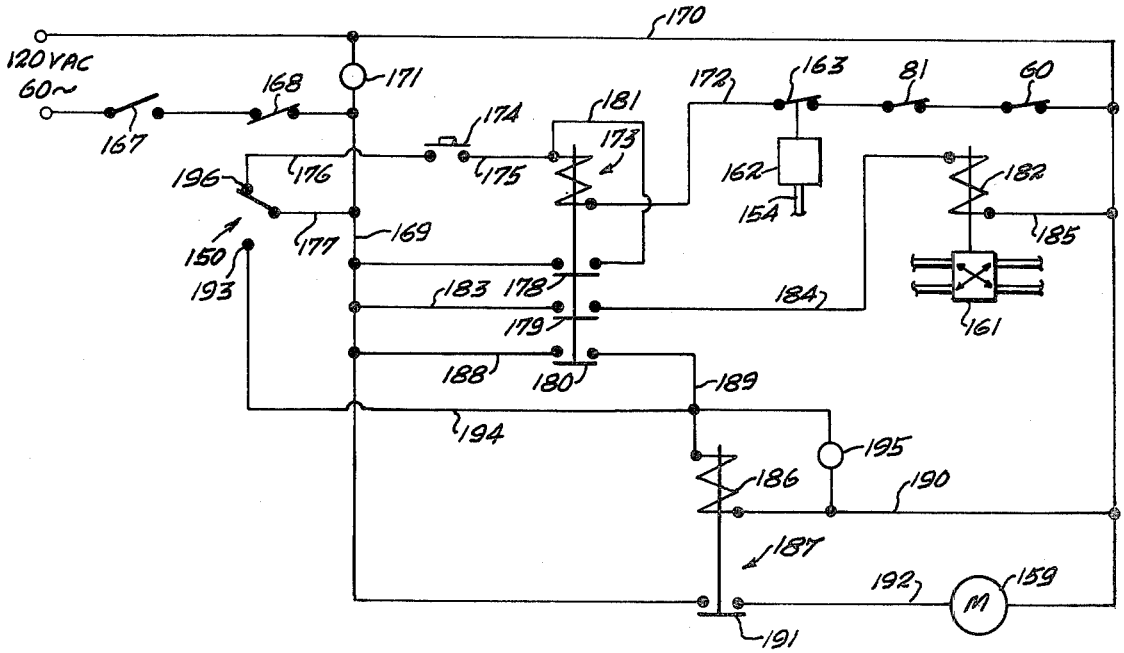
FIG. 9 is a schematic diagram of the electrical circuitry controlling the operation of the compactor.

Referring now to FIG. 9 for consideration of the operation of the electrical circuitry, electrical power such as from a 120 VAC supply has one terminal connected in series with key switch 167 and circuit breaker or reset switch 168 to common energizing conductor 169. The other terminal of the energizing source connects through conductor 170 to one energizing terminal of hydraulic pump motor 159. A panel indicator lamp 171 connected across energizing conduits 169 and 170 serves to indicate when the operating key switch 167 is closed preparatory to instituting a cycle of ram operation, and further serves to indicate whether or not the overload circuit breaker switch 168 is in open circuit condition due to malfunction of the compactor. As illustrated in FIG. 1, key switch 167, indicator lamp 171 and overload circuit breaker or reset switch 168 are located in front panel 87. Energizing conductor 170 also connects dolly latch interlock switch 60 and chute cover interlock switch 81 in series with normally-closed single-pole switch 163 of fluid pressure switch 162 through conductor 172 leading to one energization terminal of a control relay 173. The remaining energization terminal of said control relay is connected in series with manual control push button cycling switch 174 and limit switch 150 to energizing conductor 169 through conductors 175, 176, 177. Relay 173 controls normally open relay switches 178, 179, and 180. Relay switch 178 is in series with common energizing conductor 169 and conductor 181 leading to the energizing terminal of relay 173 common with energizing conductor 175, and therefore serves as a latching circuit as is hereinafter described. Relay switch 179 is in a series circuit with common energizing conductor 169, solenoid energizing winding 182 of flow reversal valve 161, and energizing conduit 170 through conductors 183, 184 and 185. Relay switch 180 is in a series circuit with common energizing conductor 169, energizing winding 186 of motor contactor 187 and energizing conductor 170 through conductors, 188, 189 and 190. Contactor switch 191 of motor contactor relay 187 connects in series with energizing conductor 169 and the remaining energization terminal of hydraulic pump motor 159 through conductor 192. The normally open contact 193 of limit switch 150 connects through conductor 194 with conductor 189 energizing motor contactor relay energizing winding 186, and indicator lamp 195 connected across said winding indicates when the hydraulic pump motor 159 is operating.

To start a cycle of compacting ram operation it is only required for the operator to press the cycling switch button 174 mounted in front panel 87, it being understood that the main key switch 167 will first have been actuated. Such "unlocking" of the energizing circuit will momentarily energize control relay 173 through limit switch 50 from main energizing conduit 169 and through closed pressure control switch 163, closed chute door interlock switch 81, and closed dolly latch interlock switch 60 leading to energizing conduit 170. Such momentary energization of relay 173 will close an auxiliary latching circuit for energizing said relay through conductors 169 and 181, thereby retaining its energization after the cycling switch 174 is released. Closure of relay switch 180 serves to energize motor contactor relay 186 from energizing conductor 169 through a series circuit comprising conductors 188, 189 and 190 to energizing conductor 170. The energization of motor contactor relay 186, in turn, closes its associated switch 191 to complete an energization circuit to hydraulic pump motor 159 through conductor 192. Thus, upon energization of the control relay 173 as described above, fluid flow reversal solenoid 182 will be actuated to apply pressurized hydraulic fluid through fluid conduit 154 to the upper end of hydraulic ram cylinder 119. At the same time, hydraulic pump motor 159 will be energized to pump fluid for forcing hydraulic cylinder piston rod 118 in the downward or compacting direction. Upon this occurring, it will be noted that the actuating lever 151 of limit switch 150 will be released to deactuate said switch, whereupon normally-closed upper contact 196 will be open circuited and contact switch 193 will become close circuited, as illustrated by the broken-line representation thereof in FIG. 5. The hydraulic ram assembly will thus continue to move down in the manner hereinabove described to compact waste in the dolly receptacle bin 53. When the waste has been sufficiently compacted, as determined by back pressure on the ram plate 107, the increased fluid pressure thereby effected in fluid conduit 154 serves to actuate pressure switch 162, thus open circuiting its switch 163 which, in turn, opens the above-described energization circuit for control relay 173. The de-energization of control relay 173 open circuits the energization circuit for solenoid-actuated flow reversal valve 161, switching said valve so that hydraulic fluid under pressure will flow now through conduit 153 and return to the motor pump through conduit 154, thereby forcefully withdrawing piston rod 118 to its uppermost position, whereat, as described above, actuating arm 151 of limit microswitch 150 will be actuated to close circuit with its contact 196. At this instant, motor contactor 187 will be deenergized by virtue of open-circuiting of above-described energization circuit to its associated energizing winding 186, to discontinue operation of hydraulic pump motor 159. The hydraulic piston ram plate 107 will thus remain at its uppermost inclined position until the next cycle of compaction is instituted by manual actuation of push-button cycling switch 174.

It is to be understood that if there is enough refuse in the refuse bin 53 to effect sufficient back pressure to initiate hydraulic piston reversal as described above, the hydraulic piston will extend somewhat further downward in its cylinder to abut the lower end thereof, thereby causing the buildup in pressure required for reversing the downward stroke of the ram plate in the absence of trash to be compacted.

The dolly bin 53 will preferably be lined with a vinyl bag for containing the compacted refuse upon removal from the dolly bin, thereby facilitating ultimate disposal. To remove the compacted waste it is only necessary to withdraw the dolly 12 sufficiently to permit pivotal opening of the upper portion 54 of the bin.

While I have illustrated and described herein only one form in which my invention can conveniently be embodied in practice, it is to be understood that this embodiment is presented by way of example only and not in a limiting sense. My invention, in brief, comprises all the embodiments and modifications coming within the scope and spirit of the following claims.

What I claim as new and desire to secure by Letters Patent is:

1. A portable solid waste compactor comprising, in combination, an upstanding main compactor unit, said main compactor unit comprising a rectangular framework defining a front opening at the lower end thereof, a compactor ram, mechanism supporting said compactor ram from the upper end of said framework, hydraulic drive means for reciprocatively moving said ram vertically downwardly within said main compactor unit, a waste bin dolly, said waste bin dolly being removably receivable within said lower end front opening of said framework, said waste bin dolly supporting a box-like enclosure bin having a top opening to receive a lower end portion of said reciprocative ram when said dolly is received within said lower end front opening, said upstanding main compactor unit comprising a forwardly and upwardly-inclined, open-topped chute above said waste bin dolly when contained within said lower end front opening for feeding waste to be compacted angularly into said dolly bin, the opening of said chute being defined by a horizontal rectangular support structure located at a level below that of said upper end of said framework, said compactor ram comprising, at its lower end, a substantially flat ram plate member operative, in its reciprocative movement, to compact trash fed through said chute into said dolly bin, and means controlled by said ram plate reaching its uppermost position in a cycle of reciprocative motion of said ram for tipping the forward end of said ram plate angularly upwardly to minimize obstruction to the passage of refuse fed through the top of said chute into said bin, said ram plate, when in its uppermost position in a cycle of reciprocative motion of said ram, being at a position intermediate the upper end of said dolly bin and the top opening of said chute, said means for tipping the foreward end of said ram plate angularly upwardly comprising a pair of ram slide bar cylinders extending vertically from the upper end of said main compactor, a pair of slide bars slidingly disposed, one each, in said slide bar cylinders, means pivotally connecting lower end portions of said slide bars with respect to laterally-opposed, rear portions of said ram plate member at the upper side thereof, means pivotally journalling the lower end of said hydraulic piston ram to a central portion of the upper side of said ram plate member, a cam member fixed with respect to and between said ram slide bar cylinders, and a cam follower fixed with respect to said lower end of said hydraulic cylinder piston rod and cooperative with said cam member for rotating said ram plate about said pivotal connection with said ram slide bars when in uppermost positions in their respective ram slide bar cylinders until said slide bars and said hydraulic cylinder piston rod are in substantially parallel relative disposition and said flat ram plate lies in a substantially horizontal plane.

2. A portable solid waste compactor as defined in claim 1, wherein said compactor ram comprises a double-acting hydraulic cylinder, a hydraulic cylinder pump system, including an electrically driven pump, for forcing hydraulic fluid in one direction or the other into respective upper and lower end portions of said hydraulic cylinder for correspondingly moving its piston rod between extended and retracted positions, solenoid controlled valve means in said fluid pump system for reversing the flow of pressurized fluid, a hydraulic pressure actuated, normally-closed switch means in said fluid pump system portion leading to said upper end of said hydraulic cylinder and operative to open circuit upon the pressure exceeding a predetermined value, and electrical energizing circuitry including said hydraulic pump motor, said solenoid-actuated valve means, said pressure-actuated switch means and a manually controlled operating switch for instituting a sngle cycle of operation of said reciprocative ram.

3. A portable solid waste compactor as defined in claim 2, wherein said electrical energizing circuitry further includes normally-open switch means controlled to close upon said circuit dolly being fully received within said front opening of said framework unit.

4. A portable solid waste compactor as defined in claim 3, further including a hinged chute opening cover, and normally-open chute cover switch means in said energizing circuit controlled to close circuit upon said chute cover being placed in covering position with respect to said chute top opening.

5. A portable solid waste compactor as defined in claim 2, wherein said solenoid controlled valve means operates at a predetermined hydraulic pressure effected either by back-pressure being applied to the underside of said flat ram plate by trash being compacted, or by said piston rod reaching its lowermost position in said hydraulic cylinder.

6. A portable solid waste compactor as defined in claim 5, wherein said electrical energizing circuit comprises solenoid-actuated relay switch means controlling energization of said solenoid controlled valve means and said electric motor, the energization winding of said solenoid-actuated relay switch means being in a self-energizing circuit including said pressure-actuated solenoid, said dolly switch means and said chute cover switch means.

7. A portable solid waste compactor as defined in claim 1, wherein said cam member is formed with a substantially vertical cam face the upper end of which comprises a forewardly outwardly and downwardly divergent cam surface portion merging with a vertically downwardly extending portion, said cam follower comprising a cam follower wheel adapted to ride along said cam surface portions during uppermost positions of travel of said hydraulic ram plate.

8. A portable solid waste compactor as defined in claim 7, including spring tension means urging a rearwardmost portion of said flat ram plate upwardly as an assist in the pivotal turning of said ram plate when in its uppermost inclined position to its horizontal position at the beginning of its downward stroke in a cycle of reciprocative motion.

* * * * *